United States Patent [19]

Yoshikawa

[11] 4,142,846

[45] Mar. 6, 1979

[54] VALVE MEANS FOR USE IN A CONCRETE MATERIAL PUMP

[75] Inventor: Yoshiharu Yoshikawa, Gunma, Japan

[73] Assignee: Niigata Engineering Co., Ltd., Tokyo, Japan

[21] Appl. No.: 840,445

[22] Filed: Oct. 7, 1977

[30] Foreign Application Priority Data

Oct. 8, 1976 [JP] Japan ..... 51/120429

[51] Int. Cl.[2] ..... F04B 15/02

[52] U.S. Cl. ..... 417/517; 417/519; 417/900

[58] Field of Search ..... 417/517, 519, 516, 900; 137/625.21

[56] References Cited

U.S. PATENT DOCUMENTS

| | | | |
|---|---|---|---|
| 3,298,322 | 1/1967 | Sherrod | 417/517 |
| 3,726,614 | 4/1973 | Schellenberg | 417/517 |
| 3,920,357 | 11/1975 | Taylor | 417/519 |
| 3,963,385 | 6/1976 | Caban | 417/519 X |
| 4,046,166 | 9/1977 | Bender | 417/517 X |

*Primary Examiner*—Carlton R. Croyle
*Assistant Examiner*—R. E. Gluck
*Attorney, Agent, or Firm*—Sughrue, Rothwell, Mion, Zinn and Macpeak

[57] ABSTRACT

A valve means for changing over concrete material passage is disclosed, wherein a rotational frusto-conical valve body is provided in a hopper. The interior of the valve body is provided with curved circular concrete material intake and discharge passages, the openings of which are alternatingly communicated with openings of double cylinders having pistons therein by rotating the valve body. The other end of the discharge passage is rotatably connected to a pipe to supply the concrete material into the outside of the hopper.

9 Claims, 5 Drawing Figures

VALVE MEANS FOR USE IN A CONCRETE MATERIAL PUMP

BACKGROUND OF THE INVENTION

The present invention relates to a fluid passage change over valve means, and more particularly to a valve means for use in a concrete pump having stationary double cylinders and pistons for intaking and discharging the concrete material alternatively.

Recently, crude concrete having low slump and including large gravel particular therein is used in civil engineering work. Such tendency will presumably increase in the future. In case of the employment of such kind of concrete material, it is necessary to reduce any resistive force exerted on discharge and intake passages, and switching of the flowing direction of the concrete should be easily made while reducing disadvantageous power or energy loss.

Conventionally, there has been a change-over-valve means for discharging crude concrete material, in which pistons are provided in double concrete cylinders, respectively, and alternatingly reciprocated therein, and simultaneously, intake and discharge ports are alternatingly opened and closed by flap valves disposed in the respective cylinders. However, such concrete pump may not perform excellent concrete intake and discharge properties, since the part to be sealed also functions as a fluid passage, and further, excellent durability may not be obtained.

Another type of concrete pump has been proposed in which double cylinders having a piston therein respectively are provided in a hopper, and a discharge pipe is pivotably provided to alternatingly communicate with the intake and discharge ports in response to the reciprocating movement of the piston. However, in such device, though intake and discharge properties may be improved, extremely large resistive force is subjected to the discharge pipe in switching operation of the pipe, particularly, in case of using a crude concrete having low slump and including large gravel, since extremely large power is required to shove aside the crude concrete material in order to move the pipe in the hopper. Further, total rigidity would become lowered because of the structure per se, which may reduce mechanical reliability.

SUMMARY OF THE INVENTION

It is therefore an object of the present invention to eliminate the above-mentioned drawbacks and disadvantages and to provide an improved fluid change-over valve means adapted to be used in the crude concrete materials.

Briefly, according to the present invention, the above-mentioned drawbacks can be eliminated by providing a rotational change-over valve means having frusto-conical shape in a hopper. The interior of the valve body is provided with curved circular concrete material intake and discharge passages, the opening of which are alternatingly communicated with the openings of the double cylinders by the revolution of the valve body so as to easily intake and discharge the crude concrete materials. The other end of the discharge passage is rotatably connected at a pipe to discharge the concrete material into the outside of the hopper.

DETAILED DESCRIPTION OF THE PREFERRED EMBODIMENTS

Figure 1:
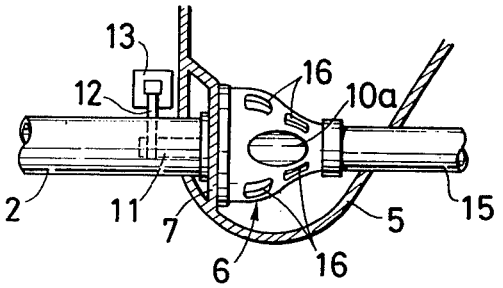
FIG. 1 is a side view showing one embodiment of the present invention.

A first embodiment of the invention will now be described in detail with reference to FIGS. 1 to 4, wherein double concrete cylinders 1 and 2 are provided with pistons 3 and 4 therein, respectively. Ports 1*a* and 2*a* of the cylinders 1 and 2 for intaking and discharging the concrete materials are opened into a hopper 5. A change-over valve body 6 is provided in the hopper 5 and is rotatably connected to the cylinders 1 and 2 through a hopper frame 7 and a seal member 8 which prevents the concrete materials from leakage.

For purposes of the following description, the "top" and "bottom" of the frusto-concial valve body will be used to designate the small and large diameter surfaces, respectively, of the frusto-cone. This should not be interpreted to mean, however, that the valve is limited to operation with the large diameter surface below the smaller diameter surface. The valve body 6 is frusto-conical shape, in which a discharge passage 9 and an intake passage 10 are provided. One end of the discharge passage 9 is positioned at the top portion of the valve body to form a circular discharge opening 9*a*. The center of the opening 9*a* is at the central axis of the frusto-conical valve body 6. The other end of the discharge passage 9 is opened at the bottom of the valve body 6 to form a discharge opening 9*b*. One end of the intake passage 10 is opened at the conical surface of the valve body 6 to form an intake opening 10*a*, while the other end of the intake passage 10 is opened at the bottom of the valve body 6 to form an intake opening 10*b*. The intake and discharge openings 10 and 9 have uniform diameter in cross section throughout their length, and the discharge opening 9*b* and the intake opening 10*b* are symmetrically positioned with respect to a diameter of the bottom of the valve body 6. These openings 9*b* and 10*b* are communicated with the intake and discharge ports 1*a* and 2*a* of the cylinders 1 and 2. The passages have a curved cylindrical shape, i.e., a shape which would be obtained by bending a circular cylinder. In other words, a curved cylindrical shape may be a passage having a curved central axis and a cross section which is substantially uniform at any point along the axis through a plane perpendicular to the axis. Since the curvature of the passages 9 and 10 are gentle, and since the cross sectional shape of these passage is circular, excellent fluid discharging properties can be obtained. Further, since the crude concrete material is directly introduced into the intake passage 10 from the hopper 5, and since the curvature of the passage 10 is gentle, and the diameter of the passage is uniform throughout its length, excellent fluid intaking properties can be obtained. Furthermore, since the valve body 6 is in truncated frusto-conical shape and is revolvable about its axis, exertion of the external resistance caused by the crude concrete material to the valve body can be reduced, and high rigidity of the valve body can be obtained.

Reference numeral 11 designates a shaft for rotating the valve body 6, one end of which is embedded into the bottom of the valve body 6 in an axial alignment with the central axis of the valve body. The shaft 11 is passed through the hopper frame 7 and the seal member 8 and is extended to the central space defined between the cylinders 1 and 2. The free end of the shaft 11 is connected to an actuator 13 such as hydraulic cylinder and hydraulic motor for steppingly rotating the valve body 6 through an operation arm 12. Steppingly rotating refers to the rotation of the valve body through a predetermined arc so that the cylinders are aligned with the intake and discharge openings. The actuator 13 also permit the valve body 6 to urge toward the cylinders. Since the valve body 6 is positioned in the hopper 5, even if the concrete material is leaked out through the sealed portion, the leaked concrete material is still in the hopper, to thereby avoiding disadvantageous loss thereof.

The discharge opening **9*a* is rotatably connected to a pipe 15 through a tapered pipe 14. Agitating or stirring plates 16 which are so called paddles are provided at the other peripheral surface of the valve body 6 in order to stir the concrete material and prevent them from solidification in the hopper 5 and also to promote intaking action of the concrete material into the intake opening 10*a*. The paddles 16** can be eliminated if desired.

Figure 2:
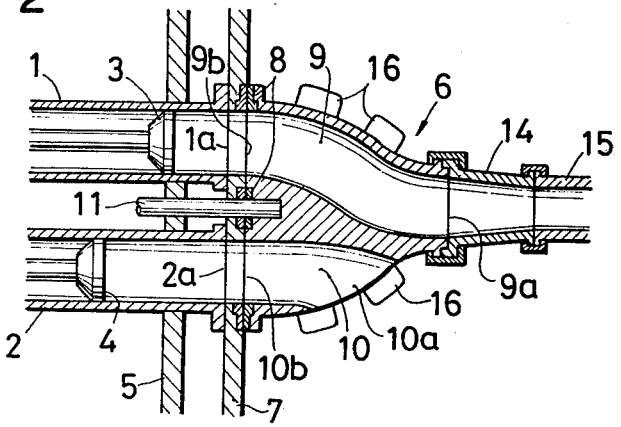
FIGS. 2 and 3 are transverse sectional views of the embodiment of FIG. 1.
Figure 3:
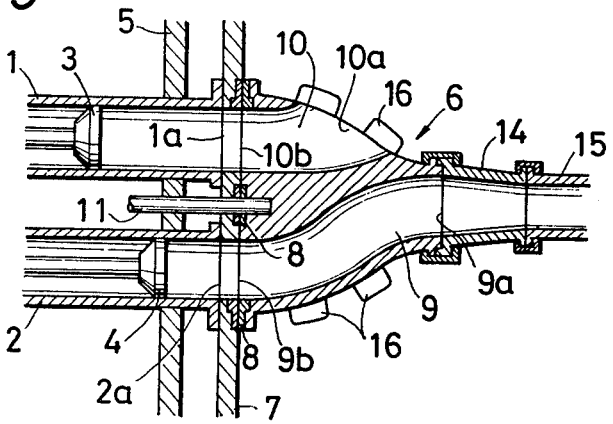
Figure 4:
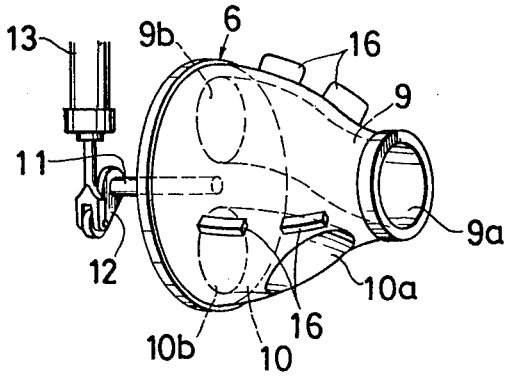
FIG. 4 is a perspective view of the valve body according to the present invention.

In operation, as shown in FIGS. 1 and 2, in the state where the ports **1*a* and 2*a* of the cylinders 1 and 2 are communicated with the discharge openings 9*b* and the intake opening 10*b*, respectively, if the piston 3 is moved rightwardly, and simultaneously, the piston 4 is moved leftwardly, the concrete material in the cylinder 1 is transferred to the pipe 15 through the discharge opening 9*b*, discharge passage 9, discharge opening 9*a* and the tapered pipe 14, while the concrete material in the hopper 5 is introduced into the cylinder 2 through the intake opening 10*a*, intake passage 10 and intake opening 10*b*. Then the valve body 6 is revolved by 180° by the rotation of the shaft 11 by means of switching operation of the actuator 13, so that the port 1*a* of the cylinder 1 and the port 2*a* of the cylinder 2 are communicated with the intake opening 10*b* and the discharge opening 9*b*, respectively, as shown in FIG. 3. Thereafter, the piston 3 is moved leftwardly to introduce the concrete material into the cylinder 1 through the intake opening 10*a*, intake passage 10, intake opening 10*b*, and port 1*a*, while the piston 4 is moved rightwardly to transfer the concrete material contained in the cylinder 2 to the pipe 15 through the port 2*a*, discharge opening 9*b*, discharge passage 9, discharge opening 9*a* and the tapered pipe 14. Next, the valve body 6 is revolved by the switching operation of the actuator 13, so that the port 1*a* of the cylinder 1 and the port 2*a* of the cylinder 2 are communicated with the discharge opening 9*b* and the intake opening 10*b*, respectively as shown in FIG. 2**. Such operation is repeatedly carried cut to continuously discharge the concrete material.

Figure 5:
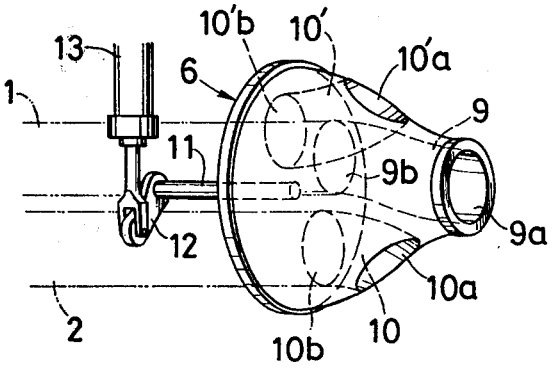
FIG. 5 is a perspective view showing another embodiment of the valve body according to the present invention.

In the second embodiment of the invention shown in FIG. 5 wherein like parts and components are designated by the same reference numerals and character as those shown in FIGS. 1 to 4, The revolvable valve body 6 is in truncated frusto-conical shape identical to that of the first embodiment. The interior of the valve body is provided with a couple of intake passages 10 and 10' and the discharge passage 9. Openings of these passages at the bottom surface of the valve body 6, namely, the discharge opening **9*b*, and intake openings 10*b* and 10*b'* are so positioned that the each of the distances in radial direction between the center of the bottom of the valve body and the center of each of the openings are equal with each other, and the discharge opening 9*b* is positioned between the openings 10*b* and 10*b'*. The distance between the center of the opening 9*b* and the center of the opening 10*b* is equal to the distance between the center of the opening 9*b* and the center of the opening 10*b'***.

With this structure, the rotation angle of the valve body 6 can be reduced. For example, if the angle defined by the line connected between the center of the bottom of the valve body and the center of the opening **9*b* and the line connected between the center of the bottom of the valve body and the center of the opening 10*b* is 60°, and the angle defined by the line connected between the center of the bottom of the valve body and the center of the opening 9*b* and the line connected between the center of the bottom of the valve body and the center of the opening 10*b'* is 60°, the switching operation can be achieved by rotating the valve body 6** only by 60°.

According to the present invention, the dimension of the sealing part i.e., sliding part can be selected dependent upon the hopper frame. The sealing member 8 is easily exchanged by a new seal member by using wear-resistant steel, such as wear plate or float seal when the seal member is worn out.

Further, it is possible to urge the valve body toward the cylinders 1 and 2 to reduce accidental clearance at the seal portion. It is also possible to eliminate the hopper frame to directly connect the cylinders 1 and 2 with the valve body 6.

Furthermore, in the above two embodiments, the discharge passage 9 can be modified to be tapered to have a reducing diameter in cross section along the flowing direction, to thereby directly connect the opening **9*a* with the pipe 15 without the employment of the tapered pipe 14**. This may reduce pressure loss of the passageway in the hydrodynamics standpoint. Moreover, since the present invention is of simple and compact structure, it is easy to load the valve means on a truck chassis.

Alternatively, pipes are employed as the intake and discharge passages and metal plate is used to form the frustoconical shaped valve body. In such case, the weight of the valve means can be reduced.

What is claimed is:

1. A valve means for use in a concrete material pump having stationary double cylinders and pistons for alternatively intaking and discharging the concrete material, respectively, comprising:

(a) a valve body provided in a hopper, said valve body having a substantial frusto-conical shape and being steppingly revolvable between a plurality of stationary positions, (b) at least one concrete material intake passage formed in said valve body, and having one end opened at a frusto-conical surface of said valve body to form a first intake opening and having the other end opened at a bottom of said valve body to form a second intake opening, said second intake opening being selectively communicable with an open end of one of said cylinders at one of the stationary positions of said valve body, and (c) a concrete material discharge passage formed in said valve body, and having one end opened at a top of said valve body to form a first discharge opening and having the other end opened at the bottom of said valve body to form a second discharge opening, said second discharge opening being selectively communicable with an open end of the other of said cylinders at said one stationary position of said valve body, whereby the concrete material contained in said hopper is intaken into said one of said cylinders through said intake passage with a retracting movement of one of said pistons, and the concrete material contained in the other of said cylinders is discharged into outside of said hopper through said discharge passage with extending movement of the other of said pistons.

2. A valve means as defined in claim 1, wherein a plurality of concrete material intake passages are provided in said valve body.

3. A valve means as defined in claim 1, wherein said concrete material passages are curved cylindrical shape.

4. A valve means as defined in claim 1, further comprising a plurality of stirring plates provided at the frusto-conical surface of said valve body.

5. A valve means as defined in claim 1, wherein said discharge passage is connected to a pipe section which is tapered to have a reducing diameter in cross section along flowing direction of the concrete material.

6. A valve means as defined in claim 1, further comprising a hopper frame interposed between said cylinders and said bottom of said valve body.

7. A valve means as defined in claim 1, further comprising an exchangeable sealing member provided at said bottom of said valve body.

8. A valve means as defined in claim 1, wherein said valve body is urged to press toward said cylinders to eliminate gaps between said bottom of the valve body and said openings of said cylinders.

9. A valve means as defined in claim 1, wherein said intake and discharge passages are pipes and said valve body is formed by a metal plate, whereby total weight of the valve means is reduced.

* * * * *